US012201224B2

(12) United States Patent
Smit

(10) Patent No.: US 12,201,224 B2
(45) Date of Patent: Jan. 21, 2025

(54) SEAT, PARTICULARLY FOR PLAYING VIDEO GAMES

(71) Applicant: F. SMIT HOLDING B.V., Doetinchem (NL)

(72) Inventor: Fernando Smit, Doetinchem (NL)

(73) Assignee: F. SMIT HOLDING B.V., Doetinchem (NL)

( * ) Notice: Subject to any disclaimer, the term of this patent is extended or adjusted under 35 U.S.C. 154(b) by 390 days.

(21) Appl. No.: 17/630,013

(22) PCT Filed: Aug. 7, 2020

(86) PCT No.: PCT/EP2020/072273
§ 371 (c)(1),
(2) Date: Jan. 25, 2022

(87) PCT Pub. No.: WO2021/023870
PCT Pub. Date: Feb. 11, 2021

(65) Prior Publication Data

US 2022/0265049 A1 Aug. 25, 2022

(30) Foreign Application Priority Data

Aug. 7, 2019 (NL) ..... 2023617
Aug. 19, 2019 (NL) ..... 2023664

(51) Int. Cl.
*A47C 5/04* (2006.01)
*A47C 3/029* (2006.01)
(Continued)

(52) U.S. Cl.
CPC ..... *A47C 5/10* (2013.01); *A47C 3/029* (2013.01); *A47C 4/045* (2013.01); *A47C 4/06* (2013.01); *A47C 7/029* (2018.08); *A47C 15/004* (2013.01)

(58) Field of Classification Search
CPC ..... A47C 5/10; A47C 3/029; A47C 4/045; A47C 4/06; A47C 7/029; A47C 15/004;
(Continued)

(56) References Cited

U.S. PATENT DOCUMENTS 2,209,145 A * 7/1940 Weber ..... A47C 5/06 297/451.3
2,482,306 A * 9/1949 Waldheim ..... A47C 3/029 297/270.3
(Continued)

FOREIGN PATENT DOCUMENTS

CN 2532749 Y 1/2003
CN 203234354 U 10/2013
(Continued)

OTHER PUBLICATIONS

PDF of machine translation of FR 2182590 (Year: 1973).*
(Continued)

*Primary Examiner* — Robert Canfield
(74) *Attorney, Agent, or Firm* — KDW Firm PLLC

(57) ABSTRACT

A seat, particularly for playing video games, includes a tubular frame, a seat surface and a backrest. The seat surface and the backrest are formed by a piece of cloth tensioned in the frame, and the frame includes two lower frame parts extending forward from the backrest and each having a curved progression which is convex in downward direction. Each lower frame part can have a front outer end and a rear outer end, and the two lower frame parts can be connected to each other close to their front outer ends and close to their rear outer ends by front and rear transverse frame parts, which can each have a curved progression which is convex in upward direction. A tubular frame and a cloth are configured for application in such a seat.

16 Claims, 7 Drawing Sheets

Figure 1:
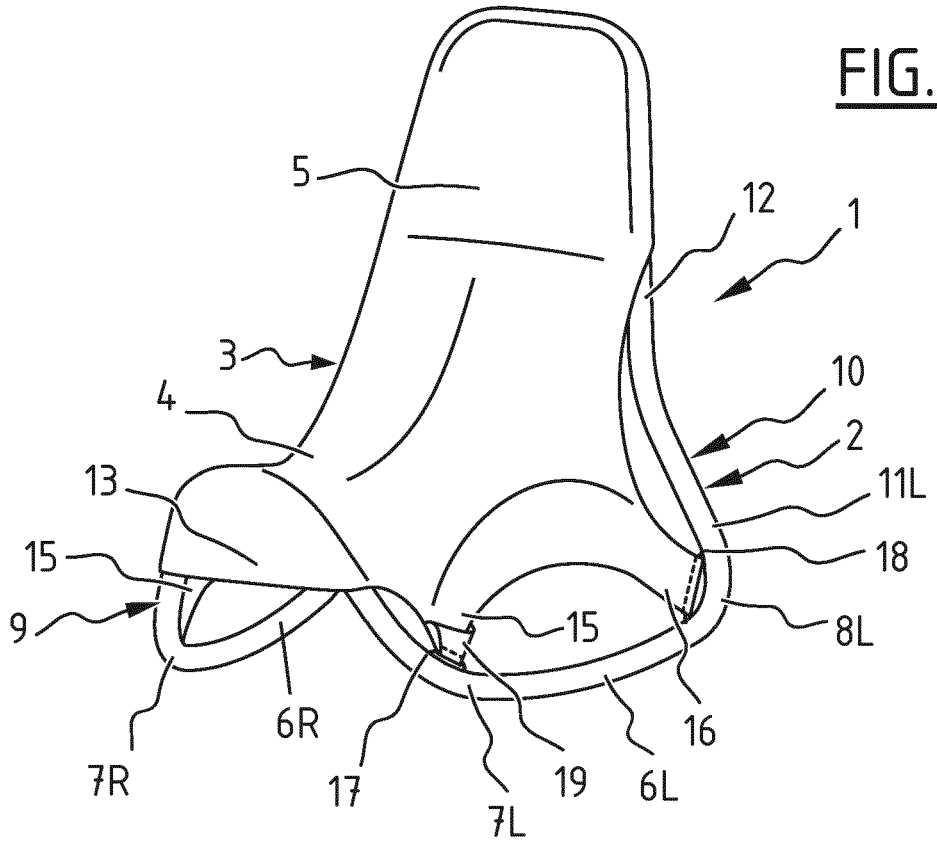

(51) Int. Cl.

| | |
|---|---|
| ***A47C 4/04*** | (2006.01) |
| ***A47C 4/06*** | (2006.01) |
| ***A47C 5/10*** | (2006.01) |
| ***A47C 7/02*** | (2006.01) |
| *A47C 15/00* | (2006.01) |

(58) Field of Classification Search
CPC .... A47C 5/04; A47C 3/00; A47C 7/00; A47C 7/02; A47C 7/24; A47C 7/40; A47C 7/62
See application file for complete search history.

(56) References Cited

U.S. PATENT DOCUMENTS

| | | | | | |
|---|---|---|---|---|---|
| 2,564,915 | A * | 8/1951 | Nelson | A47C 3/023 | 297/440.11 |
| D168,270 | S * | 11/1952 | Lamb | D6/348 | |
| 2,854,062 | A * | 9/1958 | Hetchler | A47C 3/029 | 297/411.42 |
| 3,046,050 | A * | 7/1962 | Fowler | A47C 3/029 | 297/118 |
| 3,121,587 | A * | 2/1964 | 021964 | A47C 5/04 | 191/23 R |
| 3,123,395 | A * | 3/1964 | Glass | A47C 4/44 | 297/452.13 |
| 3,195,954 | A * | 7/1965 | Moreno | A47C 4/02 | 297/440.11 |
| 3,526,429 | A * | 9/1970 | Metzger | A47C 3/029 | 297/271.5 |
| 3,538,522 | A * | 11/1970 | Adams | A61G 7/07 | 297/148 |
| 3,708,204 | A * | 1/1973 | Wachsmann | A47C 4/03 | 108/156 |
| 3,890,660 | A * | 6/1975 | Pedler | A47D 13/102 | 297/274 |
| 4,049,314 | A * | 9/1977 | McGaffin | A47C 4/02 | 297/130 |
| 4,494,796 | A * | 1/1985 | Liebhold | A47C 4/02 | 297/440.11 |
| 4,671,568 | A * | 6/1987 | Greer | A47C 31/02 | 297/229 |
| 4,889,383 | A * | 12/1989 | Jones | A47C 4/52 | 297/54 |
| 4,919,481 | A * | 4/1990 | Garabedian | A47C 3/029 | D6/348 |
| 6,626,491 | B1 * | 9/2003 | Blome | A45F 4/08 | 297/229 |
| D527,195 | S * | 8/2006 | Clement | D6/373 | |
| 7,213,277 | B1 * | 5/2007 | Hsieh | A47C 3/029 | 5/127 |
| 7,407,229 | B1 * | 8/2008 | Chen | A47C 1/034 | 297/DIG. 7 |
| D925,241 | S * | 7/2021 | Chin | D6/348 | |
| D931,628 | S * | 9/2021 | Berlinches | D6/333 | |
| 2010/0078456 | A1 * | 4/2010 | Mottram | A47C 7/62 | 5/413 R |
| 2010/0109386 | A1 * | 5/2010 | Hensley | A47C 4/52 | 280/647 |
| 2010/0164256 | A1 * | 7/2010 | Salisbury | A47C 4/286 | 297/16.2 |
| 2013/0059667 | A1 | 3/2013 | Nadal Berlinches | | |
| 2013/0062915 | A1 * | 3/2013 | Ajrouche | A47C 1/14 | 297/188.2 |
| 2018/0206642 | A1 * | 7/2018 | Jones | A47C 7/68 | |
| 2021/0393034 | A1 * | 12/2021 | Sun | A47C 4/283 | |
| 2022/0039555 | A1 * | 2/2022 | Fritze | A47C 4/028 | |
| 2022/0287476 | A1 * | 9/2022 | Fritze | A47C 7/46 | |
| 2022/0361675 | A1 * | 11/2022 | Smit | A47C 5/04 | |
| 2023/0397737 | A1 * | 12/2023 | Jung | A47C 4/54 | |

FOREIGN PATENT DOCUMENTS

| | | | | |
|---|---|---|---|---|
| CN | 204580541 | U * | 8/2015 | |
| CN | 205180844 | U | 4/2016 | |
| CN | 105534104 | A | 5/2016 | |
| DE | 1810985 | A1 | 7/1970 | |
| FR | 709453 | A | 8/1931 | |
| FR | 2182590 | A1 * | 12/1973 | A47C 31/02 |
| JP | 2014079343 | A * | 5/2014 | A47C 31/02 |
| NL | 2023665 | B1 * | 4/2021 | A47C 3/02 |
| RU | 10061 | U1 | 6/1999 | |
| TW | 202110366 | A * | 3/2021 | A47C 5/004 |
| WO | WO-2021023868 | A1 * | 2/2021 | A47C 3/02 |

OTHER PUBLICATIONS

PDF of machine translation of Jp 2014079343A (Year: 2014).*
International Search Report and Written Opinion for the International Patent Application No. PCT/EP2020/072273, mailed Sep. 28, 2020, 21 pages.
International Preliminary Report on Patentability for PCT/EP2020/072273, mailed Feb. 8, 2022 (seven (7) pages.

* cited by examiner

FIG. 5
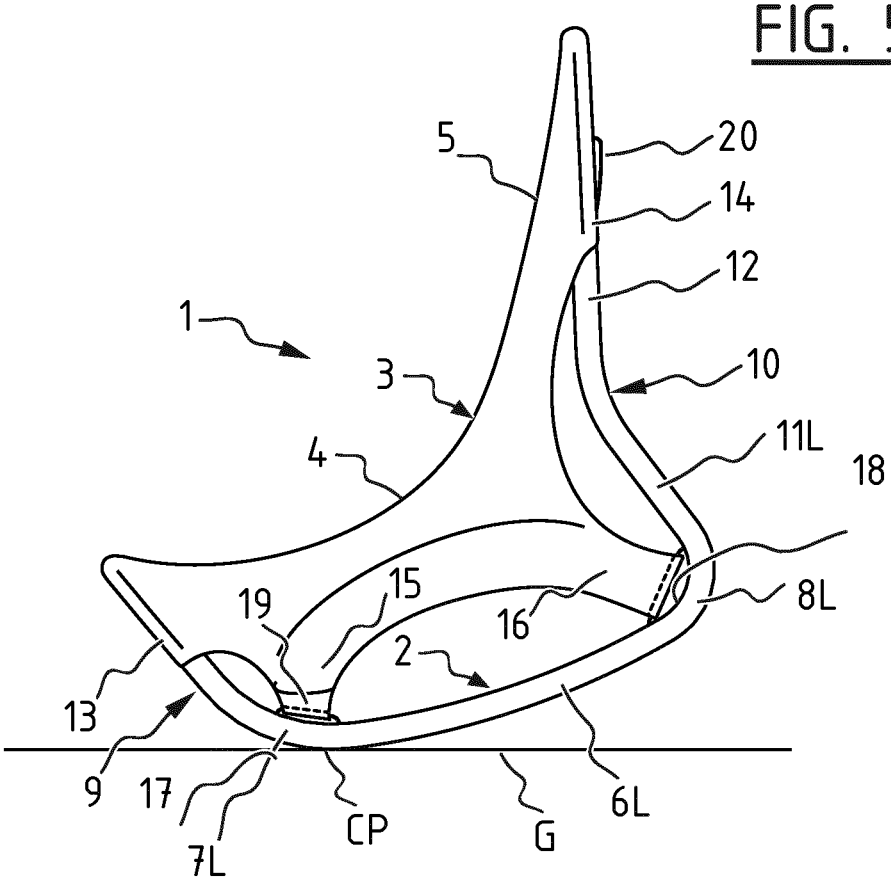
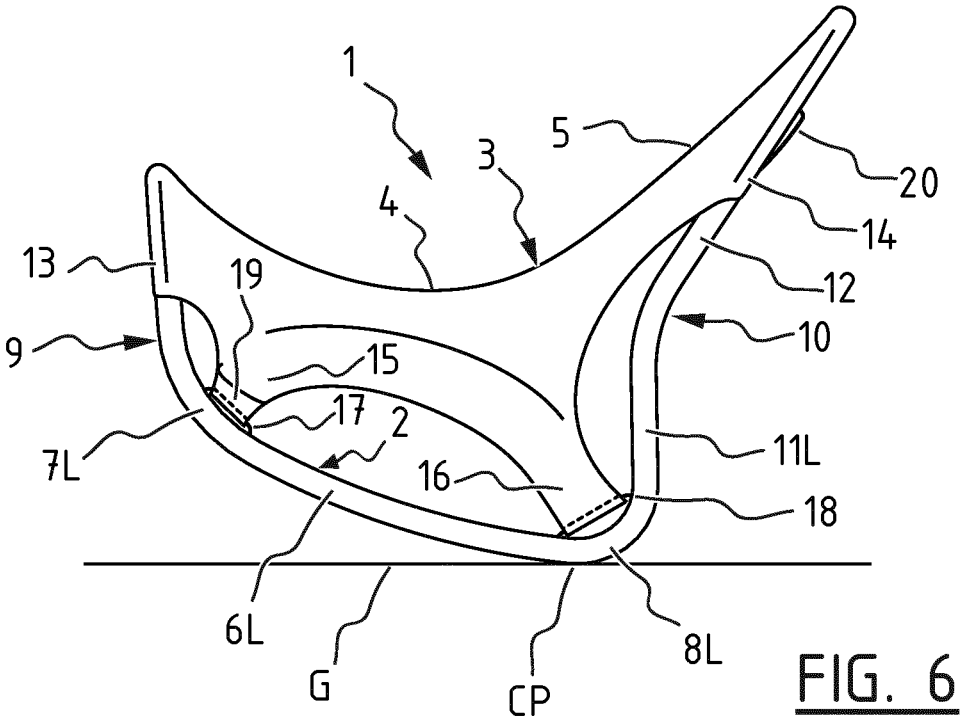
FIG. 6

FIG. 7
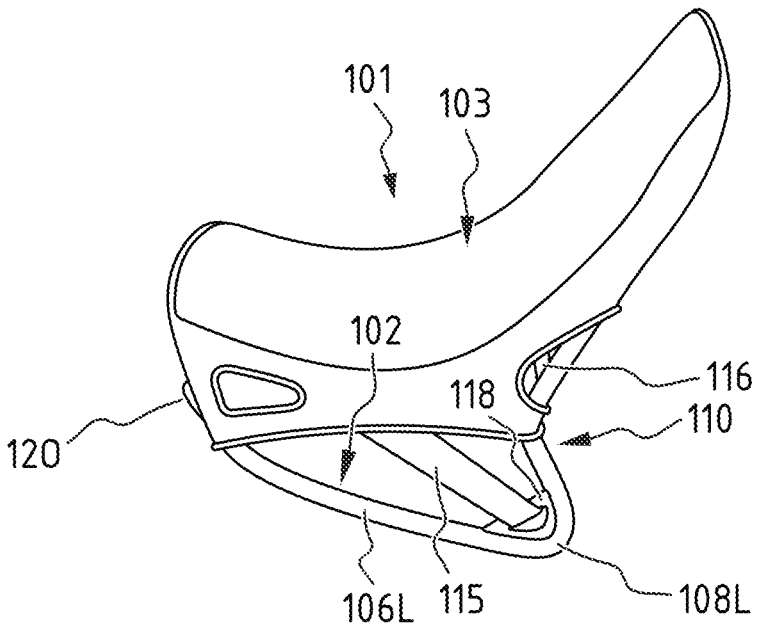
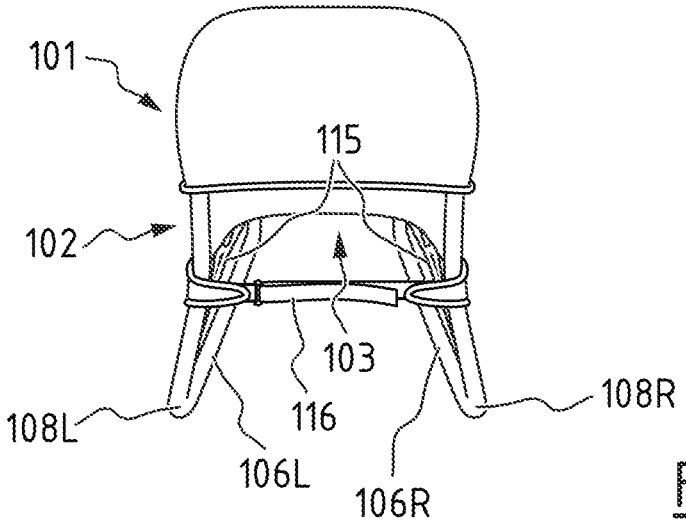
FIG. 8

FIG. 9
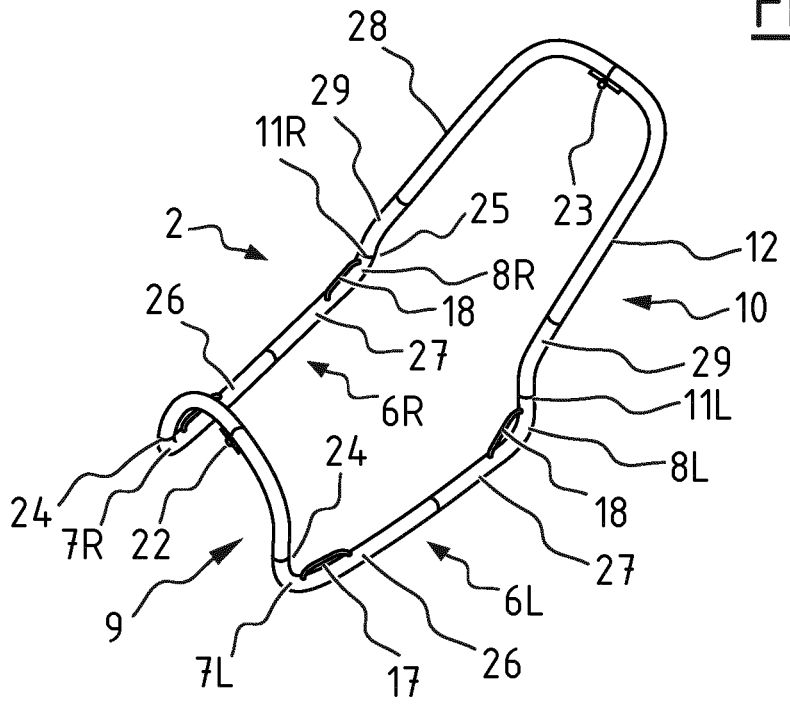
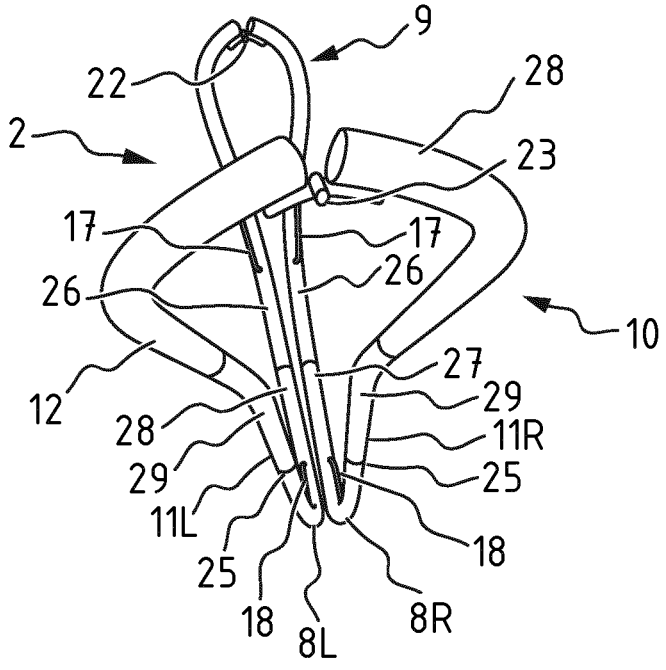
FIG. 10

SEAT, PARTICULARLY FOR PLAYING VIDEO GAMES

This application is a national stage filing under 35 U.S.C. 371 of pending International Application No. PCT/EP2020/072273, filed Aug. 7, 2020, which claims priority to Netherlands patent application serial number 2023617, filed Aug. 7, 2019, and also claims priority to Netherlands patent application serial number 2023664, filed Aug. 19, 2019, the entirety of which applications are incorporated by reference herein.

The invention relates to a seat, particularly for playing video games. The invention relates particularly to a seat which gives a user or player the option of adopting different sitting postures.

Players of video games generally sit on a sofa in front of a screen. The sitting posture of a player depends here on the video game. A player playing a racing game will thus lean relatively far back, while a player playing for instance a football game will sit more upright and leaning forward. A player can even change their sitting posture while playing a game. In the case of football games, it is thus for instance common to lean forward more when attacking, and conversely lean back more when defending. This is also the case when a player is not seated in front of a fixed screen, but is playing on a mobile device such as a tablet or a smartphone.

A seat which is used for playing video games must thus be suitable for supporting different sitting postures. In addition, when such a seat is used in a domestic environment, it is important that it does not take up too much space, since the seat will usually only be used when video games are being played. In addition, it is advantageous for the seat to also be comfortable in normal use, so that it is not usable exclusively for playing video games. Finally, such a seat should not be too expensive, since it is after all often purchased only as a gaming accessory and not so much as a piece of furniture—although it can of course be used as such.

The invention has for its object to provide a seat for playing video games which meets these requirements. According to the invention, this is achieved by a seat comprising a tubular frame, a seat surface and a backrest, wherein the seat surface and the backrest are formed by a piece of cloth tensioned in the frame, and wherein the frame comprises two lower frame parts extending forward from the backrest and each having a curved progression which is convex in downward direction. Because of the curved progression convex in downward direction of the lower frame parts, the seat in fact functions as a type of rocking chair, whereby a user will be able, depending on the stage of the game, to move further forward or conversely further rearward while sitting in the seat. Owing to the construction of the seat with a tubular frame and a cloth tensioned therein for the purpose of forming the seat surface and the backrest, the seat can be manufactured in relatively simple manner and at low cost. The seat is moreover relatively light and small, and thereby thus easy to handle and simple to store.

In an embodiment each lower frame part has a front outer end and a rear outer end, and the two lower frame parts are connected to each other close to their front outer ends and close to their rear outer ends by front and rear transverse frame parts. A continuous and strong frame is thus obtained.

The front and rear transverse frame part can here thus each have a curved progression which is convex in upward direction. The frame thus obtains sufficient height to position the seat surface at a comfortable height above the ground.

The rear transverse frame part advantageously protrudes further above the lower frame parts than the front transverse frame part. The rear transverse frame part can thus support the backrest.

In an embodiment the rear transverse frame part has two lower segments which connect to the lower frame parts and are substantially parallel to the front transverse frame part, and a rearward extending upper segment which connects to the lower segment. Because a forward extending segment first connects to each lower frame part, the lower frame parts can take a relatively long form and extend to a position under the backrest.

For a uniform progression of the movements of the seat it is important that each transition between one of the lower frame parts and one of the transverse frame parts has a curved progression. The frame thus in fact has a continuously curved progression.

When the frame is collapsible, the seat can be stored in simple manner when it is not in use.

Each of the transverse frame parts can here comprise a hinge placed substantially in a central longitudinal plane of the frame. The seat can thus take a collapsible form without the lower frame parts, which are responsible for the rocking movement, having to be interrupted for this purpose.

In addition thereto or instead thereof, the frame can be divisible. The frame can hereby be disassembled into relatively small parts when the seat is not in use. More importantly, the seat can be supplied in a small packaging as a result of the divisibility of the frame. The seat can hereby be handled and presented in a shop environment in the same way as other video game accessories, such as steering wheels, pedals, controllers and so on.

The front and rear transverse frame parts can here each be connected releasably to the lower frame parts. Because these frame parts are positioned substantially transversely of each other in the assembled state of the seat, it is important to separate them from each other during disassembly so that the different parts are not angled when in the packaging.

Each lower frame part can further be composed of at least two sections connected releasably to each other. The seat can thus be packaged even smaller.

The cloth can be tensioned between the front and rear transverse frame part and between the two lower frame parts. The cloth thus forms a double-curved surface which enables a good sitting posture. The player can thus place his or her feet firmly on the ground on either side of the seat and take on an active playing posture.

The cloth can here be provided with folded-over end parts close to a front and rear outer end thereof for the purpose of receiving the front and rear transverse frame part. The cloth can thus be slid with the folded-over end parts over the front and rear transverse frame part.

In order to prevent unintentional shifting of the cloth over the frame the front and/or the rear transverse frame part can have means for fixing the corresponding folded-over end part of the cloth.

Each lower frame part can have at least one point of attachment for attaching a tensioning member connected to the cloth or forming part thereof. In respect of the rocking movement of the chair it is after all preferred not to fold the tensioning member round the lower frame part.

The at least one point of attachment can advantageously be formed close to the rear outer end of the lower frame part in order to tension the cloth toward the lower frame parts roughly halfway between its front and rear folded-over end parts.

In an embodiment of the seat each lower frame part further has at least one point of attachment close to its front outer end. The cloth forming the seat surface and backrest is thus tensioned evenly on the frame.

In order to prevent sagging of the cloth after a period of time it can be provided with internal means for controlling the tension thereof.

These internal tension control means can advantageously comprise at least one length-adjustable element incorporated in the cloth.

The cloth can further be provided with at least one pocket for receiving a control unit for a video game and/or receiving a mobile phone. A control unit can thus be stored in the seat and always be ready for use. And by storing the mobile phone in a seat pocket a player need not keep it in his or her trouser pocket.

The invention also relates to a tubular frame for use in a seat as described above, and a cloth for use in such a seat.

Figure 2:
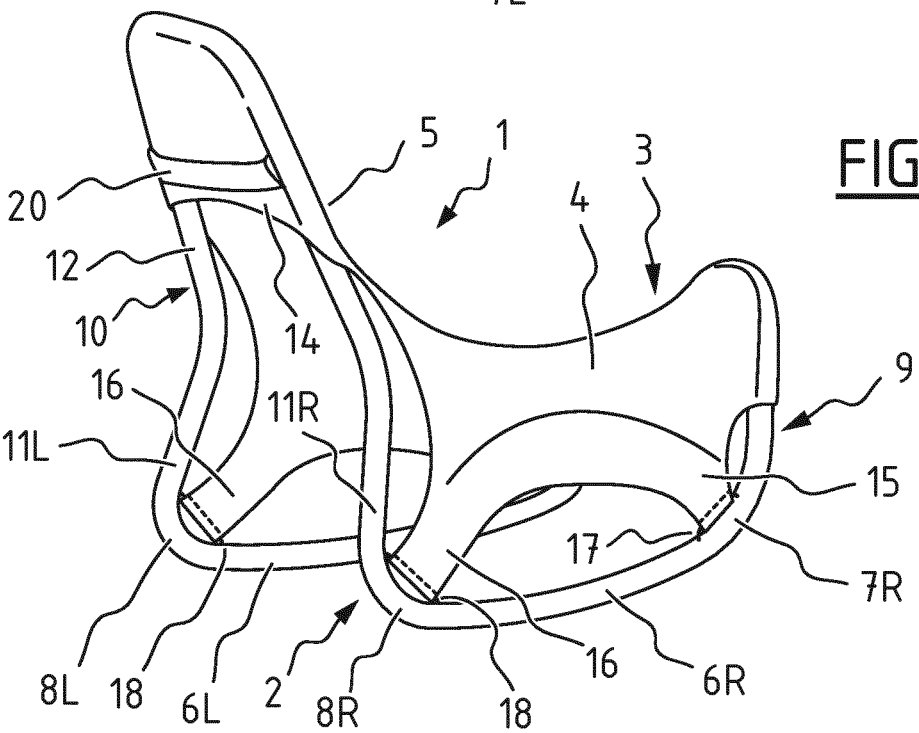
Figure 3:
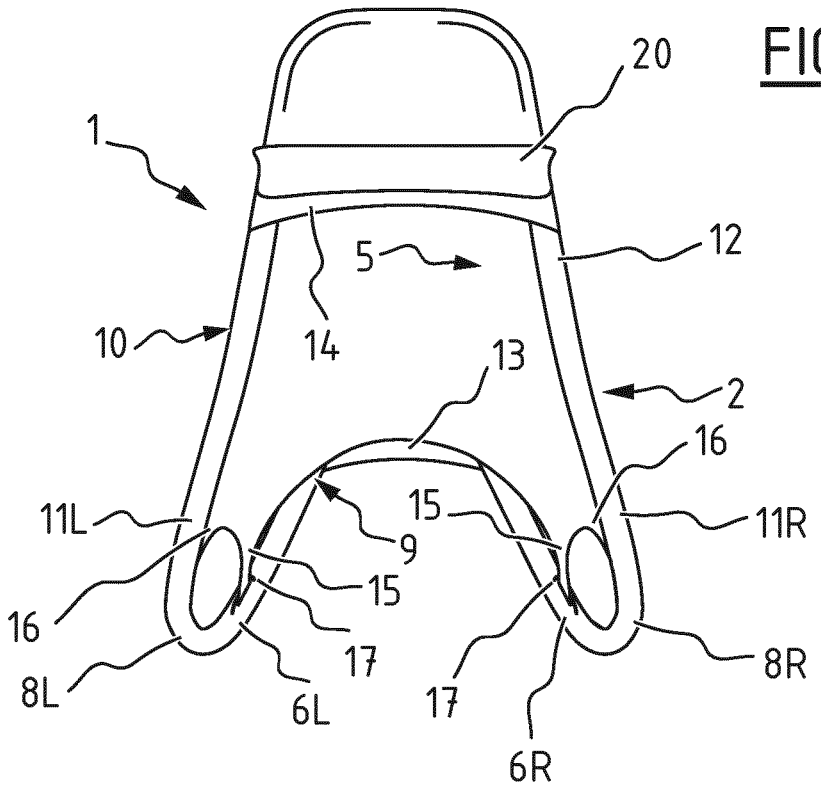
Figure 4:
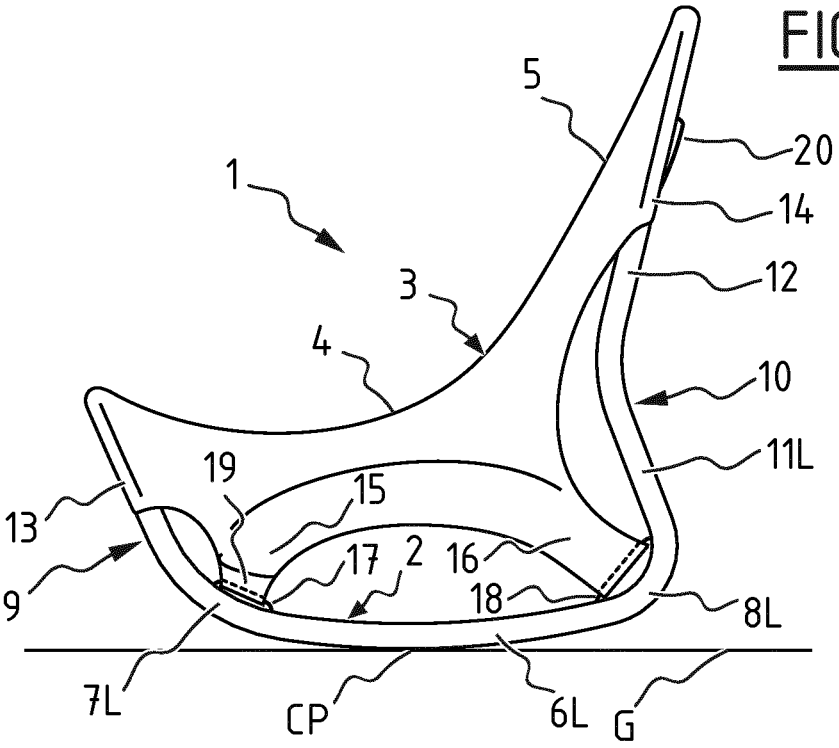
Figure 11:
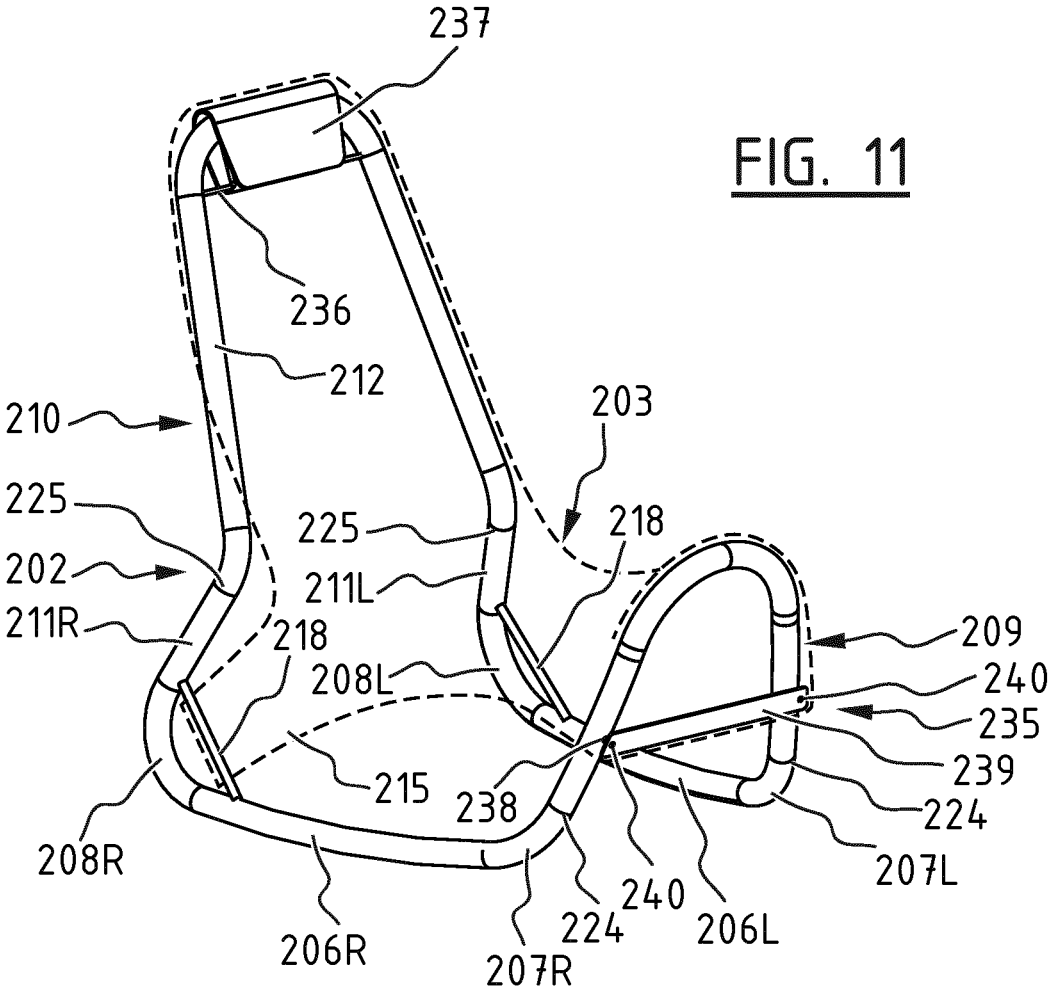
Figure 12:
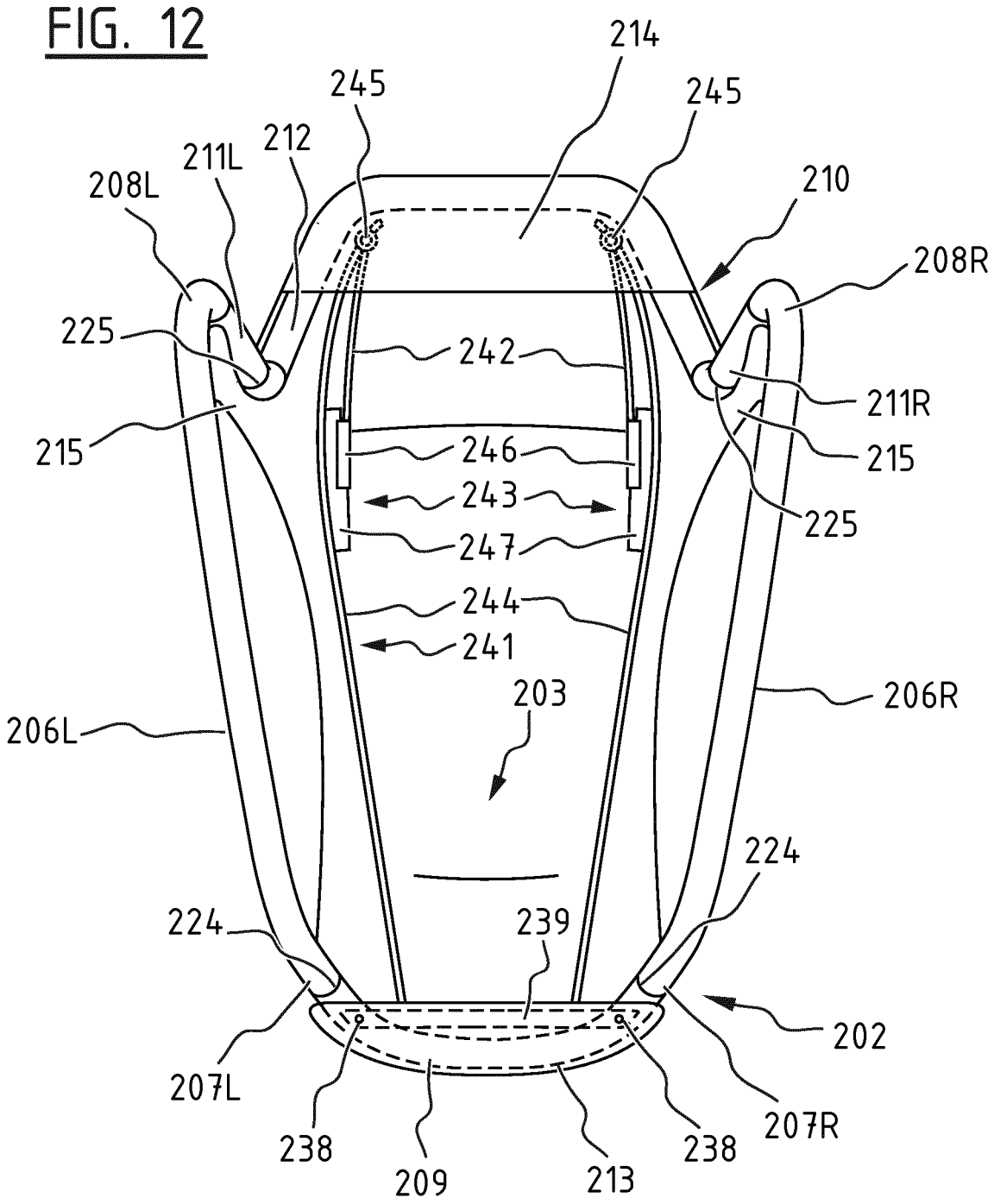

The invention is elucidated hereinbelow on the basis of a number of embodiments, wherein reference is made to the accompanying drawing in which corresponding components are designated with reference numerals increased by 100, and in which:

FIG. 1 shows a perspective front view of a seat according to an embodiment of the invention, FIG. 2 shows a perspective rear view of the seat of FIG. 1, FIG. 3 shows a rear view of the seat of FIGS. 1 and 2, FIG. 4 shows a side view of the seat of FIG. 1-3 in a first position, FIGS. 5 and 6 show views corresponding with FIG. 4 of the seat in respectively a forward inclining and rearward inclining position, FIG. 7 shows a perspective side view of an alternative embodiment of the seat according to the invention, FIG. 8 shows a perspective rear view of the seat of FIG. 7, FIG. 9 shows a perspective front view of a frame for the seat according to FIG. 1-8, FIG. 10 shows a perspective rear view of the frame of FIG. 9 in collapsed state, FIG. 11 shows a perspective front view of the frame for another embodiment of the seat, wherein the cloth is shown in broken lines, and FIG. 12 shows a bottom view of the seat according to FIG. 11.

A seat 1, particularly for playing video games, comprises a tubular frame 2 and a cloth 3 tensioned thereover and forming a seat surface 4 and a backrest 5 of seat 1 (FIG. 1-4). Frame 2 has two lower frame parts 6L, 6R extending in longitudinal direction of the seat, so in forward direction from backrest 5. Each of the lower frame parts 6L, 6R has a curved progression which is convex in downward direction so that seat 1 in fact forms a rocking chair. Each lower frame part 6L, 6R has a front outer end 7L, 7R and a rear outer end 8L, 8R. A front transverse frame part 9 connects the two lower frame parts 6L, 6R at their front outer ends 7L, 7R, while a rear transverse frame part 10 connects the lower frame parts 6L, 6R at their rear outer end 8L, 8R.

The front and rear transverse frame parts 9, 10 extend substantially transversely upward from the lower frame parts 6L, 6R and in the shown embodiment each have a curved progression which is convex in upward direction. The rear transverse frame part 10 here protrudes further above lower frame parts 6L, 6R than the front transverse frame part 9, so that rear transverse frame part 10 is able to support the upper side of backrest 5. Rear transverse frame part 10 here first has on either side a lower segment 11L, 11R which connects to the lower frame part 6L, 6R and which extends substantially parallel to the front transverse frame part 9. An upper segment 12 then connects to the two lower segments 11L, 11R, which upper segment extends rearward, so in opposite direction to the front transverse frame part 9. The backrest 5 of the seat is hereby as it were shifted forward relative to the lower frame parts 6L, 6R, whereby a player is prevented from falling backward when he or she leans against backrest 5.

In side view (FIG. 4) frame 2 thus has a substantially U-shaped cross-section, wherein one of the legs is longer than the other, while in front or rear view (FIG. 3) the transverse frame parts 9, 10 each have a reverse U-shape. The transitions between the lower frame parts 6L, 6R and the transverse frame parts 9, 10 otherwise also each have a curved progression so that frame 2 as a whole takes the form of a loop bent upward on the front and rear side (FIG. 9).

As stated, the cloth is tensioned over frame 2 in order to form the seat surface 4 and the backrest 5. Cloth 3 is for this purpose provided close to its front side and rear side with folded-over end parts 13, 14 in which the upper ends of the front and rear transverse frame parts 9, 10 can be received. Cloth 3 is thus tensioned on frame 2 in longitudinal direction of seat 1. In addition, cloth 3 is tensioned in transverse direction of seat 1 toward the two lower frame parts 6L, 6R. For this purpose cloth 3 is provided on either side with two tensioning members 15, 16 which extend toward front and rear points of attachment 17, 18 on lower frame parts 6L, 6R. These points of attachment 17, 18 here take the form of brackets which are arranged on top of the lower frame parts 6L, 6R and around which free outer ends of the tensioning members 15, 16 can be folded. In this way cloth 3, when tensioned in frame 2, forms a double-curved surface. A player can sit on seat 1 with his or her feet on either side of the lower frame parts 6L, 6R and here find a suitable sitting posture, upright (FIG. 4), leaning forward (FIG. 5) or leaning back (FIG. 6), irrespective of the game and the stage of the game. The point CP where seat 1 makes contact with the ground surface G shifts forward or rearward here.

In the shown embodiment cloth 3 is further provided on a side with a pocket 19 for receiving a player's mobile phone, while cloth 3 has on the rear side a pocket 20 for receiving a control unit for a video game.

In another embodiment of the seat 101 according to the invention (FIG. 7, 8) cloth 103 is provided with two tensioning members 115 which are attached to the points of attachment 118 close to the rear outer ends 108L, 108R of lower frame parts 106L, 106R. In addition, cloth 103 has a single tensioning member 116 which is tensioned behind the rear transverse frame part 110. In this case frame 102 thus has only two points of attachment 118, and thereby has a slightly simpler construction than the frame 2 discussed above. In this embodiment cloth 3 is otherwise provided on the front side with a pocket 120 for receiving a controller and/or a mobile phone.

FIG. 11 shows a frame 202 for a seat 201, the cloth 203 of which is provided with only two tensioning members 215 which are attached to the points of attachment 218 close to the rear outer ends 208L, 208R of the lower frame parts 206L, 206R. In order to prevent cloth 203 from shifting, the front transverse frame part 209 is in this embodiment provided with means 235 for fixing the corresponding folded-over end part 213. In the shown embodiment these fixation means 235 comprise two protruding pins 238 to which the front folded-over end part 213 can be attached. For this purpose this front folded-over end part 213 is here provided with a transverse stiffener 239 which is received therein and has at its ends two openings 240. Transverse stiffener 239 can be manufactured from a metal or a stiff plastic. A transverse rod 236 is here further arranged between the legs of the reverse U-shaped rear frame part 210, which rod co-acts with a strengthening profile 237 which is folded over the upper side of the rear transverse frame part 210. This strengthening profile simultaneously functions to support a pillow (not shown here) which can be integrated with the cloth 203.

In order to enable simple storage of seat 1 the frame 2 can be collapsible. For this purpose each of the transverse frame parts 9, 10 has a hinge 22, 23 placed in a central longitudinal plane of frame 2. Frame 2 can thus be collapsed round an axis running in longitudinal direction. This is the case for both shown embodiments of the seat 1, 101.

In order to enable seat 1 to be transported and displayed in a shop in a relatively small packaging the frame 2 can be further divisible. For this purpose the transverse frame parts 9, 10 are each connected releasably to the lower frame parts 6L, 6R at the position of separations 24, 25 (FIG. 9, 10). The lower frame parts 6L, 6R are moreover each composed of two sections 26, 27 which are connected releasably to each other, while the rear transverse frame part 10 is composed of a pivoting section 28 and two bent sections 29. Frame 2 can thus be received in a packaging in eight separate parts, wherein the cloth 3 can be packaged in folded state together with frame 2. Seat 1 can thus be put out and sold in a shop in relatively small packaging, besides other accessories for video games, such as steering wheels, pedals, control units (controllers) and so on.

The frame can otherwise also be divisible when it is not collapsible, such as frame 202. Separations 224 and 225 then serve on the one hand to enable frame 202 to be packaged smaller than a frame in one piece, but in addition also to simplify the tensioning of cloth 203 on frame 202. When the transverse frame parts 209, 210 are first connected with some clearance to lower frame parts 206L, 206R, frame 202 still has some flexibility. In that situation the folded-over end parts 213, 214 can be pulled over the front and rear transverse frame parts 209, 210 and the front folded-over end part 213 can be secured using the fixation means 235. By then making the connection between the transverse frame parts 209, 210 and the lower frame parts 206L, 206R clearance-free the cloth 203 is tensioned tightly on frame 202.

In order to enable the tension of cloth 3, 103, 203 to be varied the tensioning members 15, 16; 115, 116; 215 can firstly be length-adjustable. As stated, these tensioning members 15, 16; 115, 116; 215 have a free outer end which is folded round the relevant bracket 17, 18; 118; 218 and can then be attached to the rest of the tensioning member at different positions. For this purpose the tensioning members can for instance be provided with Velcro tape.

In the shown embodiment the cloth 203 is in addition provided with internal means 241 for controlling the tension thereof. These internal tension control means 241 here comprise two length-adjustable elements 242 which extend from the upper side of the front folded-over end part 213 to a point in the vicinity of the upper side of the rear folded-over end part 214, and are guided from there back to an adjusting zone 243. The length-adjustable elements 242 here each take the form of a cord, an end of which is attached close to the front folded-over end part 213 to cloth 203, and which is run through a hem 244 of cloth 203. Arranged close to rear folded-over end part 214 are two eyes 245 through which each of the cords 242 are run. Each cord 242 is provided at its free end with a Velcro strip 246 which co-acts with a Velcro strip 247 which is attached in the adjusting zone 243 to the inner side of cloth 203. Tightening the outer ends of both cords 242 reduces the distance between eyes 245 and the front folded-over end part 213, whereby cloth 203 is tensioned. On the other hand, the cloth can be slackened by paying out cords 242. This latter can be important to be able to pull cloth 203 over frame 202.

As stated, frame 2 can be tubular, so be constructed from for instance metal or plastic tubes. When the frame is constructed from steel tubes, it can be manufactured at relatively low cost and is relatively strong and stiff. Cloth 3 can be a woven material, a knitted material or a non-woven material. Different materials can be applied here, such as synthetic fibres or natural fibres. Cloth 3 could even be formed from leather.

Although the invention has been elucidated above on the basis of a number of embodiments, it will be apparent that it is not limited thereto but can be varied in many ways. In particular, the seat can also be used simply as a piece of furniture, particularly as a modern variant of the rocking chair, and not exclusively for playing video games. The scope of the invention is therefore defined solely by the following claims.

The invention claimed is:

1. A seat for playing video games, comprising:
a tubular frame,
a seat surface, and
a backrest,
wherein the seat surface and the backrest are formed by a piece of cloth tensioned in the frame, and
wherein the frame comprises two lower frame parts extending forward from the backrest, wherein each lower frame part has a front outer end and a rear outer end, and the two lower frame parts are connected to each other at their front outer ends and at their rear outer ends by front and rear transverse frame parts, wherein each lower frame part has a single curved progression which is convex in downward direction, and wherein the front and rear transverse frame part each have a single curved progression which is convex in upward direction.

2. The seat according to claim 1, wherein the rear transverse frame part protrudes further above the lower frame parts than the front transverse frame part.

3. The seat according to claim 1, wherein the rear transverse frame part has two lower segments which connect to the lower frame parts and are substantially parallel to the front transverse frame part, and a rearward extending upper segment which connects to the lower segments.

4. The seat according to claim 1, wherein each transition between one of the lower frame parts and one of the transverse frame parts has a curved progression.

5. The seat according to claim 1, wherein the frame is collapsible.

6. The seat according to claim 5, wherein each of the transverse frame parts comprises a hinge placed substantially in a central longitudinal plane of the frame.

7. The seat according to claim 1, wherein the frame is divisible.

8. The seat according to claim 7, wherein the front and rear transverse frame parts are each connected releasably to the lower frame parts.

9. The seat according to claim 7, wherein each lower frame part is composed of at least two sections releasably connected to each other.

10. The seat according to claim 1, wherein the cloth is tensioned between the front and rear transverse frame part and between the two lower frame parts.

11. The seat according to claim 10, wherein the cloth is provided with folded-over end parts at a front and rear outer end thereof for receiving the front and rear transverse frame part.

12. The seat according to claim 11, wherein the front and/or the rear transverse frame part has means for fixing the corresponding folded-over end part of the cloth.

13. The seat according to claim 10, wherein each lower frame part has at least one point of attachment for attaching a tensioning member connected to the cloth or forming part thereof.

14. The seat according to claim 13, wherein the at least one point of attachment is formed at the rear outer end of the lower frame part.

15. The seat according to claim 14, wherein each lower frame part further has at least one point of attachment at its front outer end.

16. The seat according to claim 1, wherein the cloth is provided with at least one pocket for receiving a control unit for a video game and/or receiving a mobile phone.

* * * * *